US012042025B2

(12) United States Patent
Bonnefoy et al.

(10) Patent No.: US 12,042,025 B2
(45) Date of Patent: Jul. 23, 2024

(54) HOOK AND EYE CLOSURE WITH ALTERNATIVE SPACING

(71) Applicant: Mast Industries (Far East) Limited, Kowloon (HK)

(72) Inventors: Aurelie Bonnefoy, Brooklyn, NY (US); Amy Toth, Long Island City, NY (US); Erin Krasner, New York, NY (US); Ursula Todaro, Glendale, NY (US); Jennifer Baratta, New York, NY (US)

(73) Assignee: Mast Industries (Far East) Limited, Kowloon Bay (HK)

( * ) Notice: Subject to any disclaimer, the term of this patent is extended or adjusted under 35 U.S.C. 154(b) by 467 days.

(21) Appl. No.: 17/066,017

(22) Filed: Oct. 8, 2020

(65) Prior Publication Data

US 2022/0110420 A1 Apr. 14, 2022

(51) Int. Cl.
*A44B 13/00* (2006.01)
*A41C 3/12* (2006.01)

(52) U.S. Cl.
CPC ..... *A44B 13/0052* (2013.01); *A41C 3/12* (2013.01); *A44B 13/0029* (2013.01)

(58) Field of Classification Search
CPC ..... A41C 3/00; A41C 3/0014; A41C 3/0028; A41C 3/12; A41F 1/006; A44B 13/00; A44B 13/0052; A44B 13/0029; A44B 13/0058; Y10T 24/4523; Y10T 24/45963
USPC ..... 450/1, 25; 2/251; 24/592.1, 697.2
See application file for complete search history.

(56) References Cited

U.S. PATENT DOCUMENTS 1,248,570 A * 12/1917 Starr ..... A41C 1/00 450/141
3,530,813 A 9/1970 Roseman et al.
6,520,832 B2 2/2003 Devita et al.
6,820,312 B1 11/2004 Senn
(Continued)

FOREIGN PATENT DOCUMENTS

EM 007009253-0001 10/2019
JP 2004263315 A 9/2004
(Continued)

OTHER PUBLICATIONS

Office Action issued in corresponding Canadian Application No. 3,095,878, dated Sep. 27, 2022, 3 pages.
(Continued)

*Primary Examiner* — Jameson D Collier
*Assistant Examiner* — Matthew R Marchewka
(74) *Attorney, Agent, or Firm* — Andrus Intellectual Property Law, LLP

(57) ABSTRACT

A closure portion for a brassiere includes an inner face configured to contact a wearer's skin while the bra is worn. An outer face faces away from the wearer's skin while the brassiere is worn. A first end is attached to a wing of the brassiere. A free second end is opposite the first end. The eyes on the outer face of the closure portion are arranged in a first column of eyes next to a second column of eyes and a third column of eyes next to the second column of eyes. A first lateral spacing is provided between the first and second columns of eyes, which first lateral spacing is different from a second lateral spacing between the second and third columns of eyes. A brassiere with such a closure portion is also provided according to the present disclosure.

18 Claims, 6 Drawing Sheets

(56) References Cited

U.S. PATENT DOCUMENTS

| | | | | |
|---|---|---|---|---|
| D530,648 | S | 10/2006 | Utaka | |
| 7,128,635 | B1 | 10/2006 | Liu | |
| D560,877 | S | 2/2008 | Utaka | |
| 7,618,305 | B2 | 11/2009 | Gut et al. | |
| 7,722,433 | B2 | 5/2010 | Utaka | |
| 7,918,711 | B2 | 4/2011 | Yeung | |
| 8,408,964 | B1 * | 4/2013 | Acker | A41F 1/006 450/82 |
| D703,095 | S | 4/2014 | Fildan et al. | |
| D763,132 | S | 8/2016 | Karunaratne et al. | |
| D813,721 | S | 3/2018 | Krupa | |
| D826,084 | S | 8/2018 | Karunaratne et al. | |
| 2013/0199005 | A1 * | 8/2013 | Fung | A44B 13/0011 24/698.2 |
| 2016/0037845 | A1 * | 2/2016 | Fung | A41C 3/0028 24/578.14 |
| 2017/0332718 | A1 | 11/2017 | Eyal et al. | |
| 2018/0303171 | A1 | 10/2018 | Lee | |

FOREIGN PATENT DOCUMENTS

| | | | |
|---|---|---|---|
| JP | 4415197 | B2 | 2/2010 |
| KR | 200303757 | Y1 * | 2/2003 |
| WO | 2014174332 | A1 | 10/2014 |
| WO | 2020100240 | A1 | 5/2020 |

OTHER PUBLICATIONS

Victoria's Secret, "Size & Fit: Bras and Bralettes," webpage, admitted prior art, available at https://customerservice.victoriassecret.com/app/answers/detail/a_id/2195/~/size-%26-fit%3A-bras-%26-bralettes.

Athleta, "Size Charts," webpage, admitted prior art, available at https://athleta.gap.com/customerService/info.do?cid=66677.

Lululemon, "Bra Sizing Chart," webpage, admitted prior art, available at https://info.lululemon.com/help/size-chart.

Nike, "Convert Your Sports Bra Size," webpage, admitted prior art, available at https://www.nike.com/us/en_us/c/size-fit-guide/womens-bra-sizing-chart.

Fabletics, "Bra Size Chart," webpage, admitted prior art, available at https://www.fabletics.com/womens/size-guide.

Under Armour, "Sports Bras," webpage, admitted prior art, available at https://www.underarmour.com/en-us/t/size-guide.html#sports-bras.

Target, "Women's High Support Convertible Strap Bra—All in Motion™," webpage, admitted prior art, available at https://www.target.com/p/women-s-high-support-convertible-strap-bra-all-in-motion/-/A-77643572?preselect=77347103#Ink=sametab.

Brooks, "How to Measure Your Bra Size," webpage, admitted prior art, available at https://www.brooksrunning.com/en_us/running-bra-fit-guide/.

Mast Industries (Far East) Limited, "Hook and Eye Closure with Alternative Spacing," Abandoned U.S. Appl. No. 16/383,217, filed Apr. 12, 2019.

Victoria's Secret Stores Brand Management, Inc., "Hook Closure Portion for a Brassiere," Abandoned U.S. Appl. No. 29/687,488, filed Apr. 12, 2019.

European Search Report in EP21199141.9, dated Mar. 30, 2022, 9 pages.

Office Action in corresponding Application CA 3,095,878, dated Jan. 10, 2022, 4 pages.

Office Action issued in corresponding Canadian Application No. 3,095,878, dated Jul. 24, 2023, 4 pages.

* cited by examiner

HOOK AND EYE CLOSURE WITH ALTERNATIVE SPACING

FIELD

The present disclosure relates to brassieres, and more specifically to hook and eye closures for brassieres.

BACKGROUND

U.S. Pat. No. 6,520,832 discloses a hook and eye closure for garments such as brassieres. The eye tape and/or the hook tape is stabilized in a vertical direction, but stretches in a horizontal direction so as to provide a comfortable and self-adjusting fit to garments. The eye tape preferably includes a soft, stretchable backing material that wraps around three edges of the eye tape and is heat-sealed to the front side. This provides a soft, seam-free back and edge portion to allow increased comfort.

U.S. Pat. No. 7,128,635 discloses a method of incorporating a fastener with a molded brassiere of a seamless construction and that includes an exterior panel of moldable material and an interior panel of moldable material that is contiguous with the exterior panel and has been laminated therewith except at least a non-laminated region where the fastener is to be located, and wherein the fastener includes a connector supported by a flexible mounting panel, the method comprising creating an opening through one of the exterior panel and the interior panel at the non-laminated region and at a location thereof through which at least part of the connector is to extend, locating the flexible mounting panel intermediate of the exterior panel and the interior panel at the non-laminated region in a manner to allow the at least part of the connector to extend through the opening, affixing at least one of the exterior panel and the interior panel to the flexible mounting panel.

U.S. Pat. No. 7,618,305 discloses a hook and eye closure for garments such as brassieres. The eye tape and/or the hook tape is formed of laminated elastically elongatable layers, and can incorporate a cushioning layer to provide a comfortable and self-adjusting fit to garments. The lamination of the elastically elongatable layers allows manufacturing on existing equipment and helps provide smooth, soft edges, particularly when ultrasonically cut.

U.S. Pat. No. 7,722,433 discloses a garment including a brassiere with a back part, in which back cloths are formed thin without concaves and convexs, and only head parts of male and female engaging devices appear on outer surfaces of the back cloths, thereby providing a stylish appearance, which is plane [sic] and neat, and providing a comfortable feeling without a feeling of discomfort when worn. The garment includes a back part of a brassiere or the like which can be freely put on and off by using the male and female engaging devices provided to the back cloths welded to an area from underarm parts toward a back of a wearer. The male and female engaging devices are integrally attached onto inner surface portions of the back cloths. The head parts and of the male and female engaging devices and are exposed to an outside through slits.

U.S. Pat. No. D530,648 discloses a hook and eye.

U.S. Pat. No. D703,095 discloses a brassiere back fastener.

U.S. Pat. No. D763,132 discloses a hook and eye fastener.

U.S. Pat. No. D826,084 discloses an eye part for a hook and eye fastener.

Japanese Patent No. 4415197 discloses an eye tape sewing system consisting of a plurality of eye clasp sewing machines installed in series and capable of transmitting/receiving data between the respective sewing machines formed so that, when a head sewing machine changes the sewing pattern, before sewing the sewing pattern after the change, the head sewing machine sews several eye clasps to be a mark of the change in the pattern by an arrangement at an eye clasp interval regularly non-used in the sewing pattern, the respective succeeding sewing machines, when reading that the mark part is transferred by an eye clasp detecting sensor, immediately change the pattern to the pattern after the change transmitted from the head sewing machine, and the respective sewing machines sew the eye clasps in lines which the respective machines take charge.

International PCT Application Publication No. WO 2014/174332 discloses a closure which comprises a main strip and a substrate and can be connected in a simple manner to the side part of an article of clothing. For this purpose, the substrate has means on a connection edge of the substrate which, after the connection to the side part has been established, result in no sewing seam being located in the plane of the soft contact surface of the substrate. The closure has sufficient tensile strength and provides a high level of wearing comfort.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one example of the present disclosure, a closure for a brassiere comprises an inner face configured to contact a wearer's skin while the brassiere is worn and an outer face configured to face away from the wearer's skin while the brassiere is worn. A first end of the closure is configured to be attached to a wing of the brassiere, and a free second end is opposite the first end. A plurality of eyes are on the outer face of the closure, and are arranged in a first column of eyes next to a second column of eyes and a third column of eyes next to the second column of eyes. A first lateral spacing between the first and second columns of eyes is different from a second lateral spacing between the second and third columns of eyes. In one example, a fourth column of eyes is next to the third column of eyes, and the third and fourth columns of eyes are separated by the first lateral spacing.

According to another example of the present disclosure, a brassiere comprises a chest-covering portion, a first wing extending from a first side of the chest-covering portion and terminating at a first closure portion, and a second wing extending from an opposite, second side of the chest-covering portion and terminating at a second closure portion. A plurality of hooks are on the first closure portion. A plurality of eyes are on the second closure portion and are configured to engage with the plurality of hooks to couple the first and second closure portions together. The plurality of eyes are arranged in a first column of eyes next to a second column of eyes and a third column of eyes next to the second column of eyes. A first lateral spacing between the first and second columns of eyes is different from a second lateral spacing between the second and third columns of eyes. In one example, a fourth column of eyes is next to the third column of eyes, and the third and fourth columns of eyes are separated by the first lateral spacing.

According to another aspect, a collection of brassieres is provided in a plurality of brassiere sizes, wherein each given brassiere size in the plurality of brassiere sizes is configured such that for the given brassiere size, at least one volumetric breast cup size is associated with at least two ribcage-encircling band sizes.

BRIEF DESCRIPTION OF THE DRAWINGS

Examples of hook and eye closures and brassieres are described with reference to the following Figures. The same numbers are used throughout the Figures to reference like features and like components.

DETAILED DESCRIPTION

Figure 1:
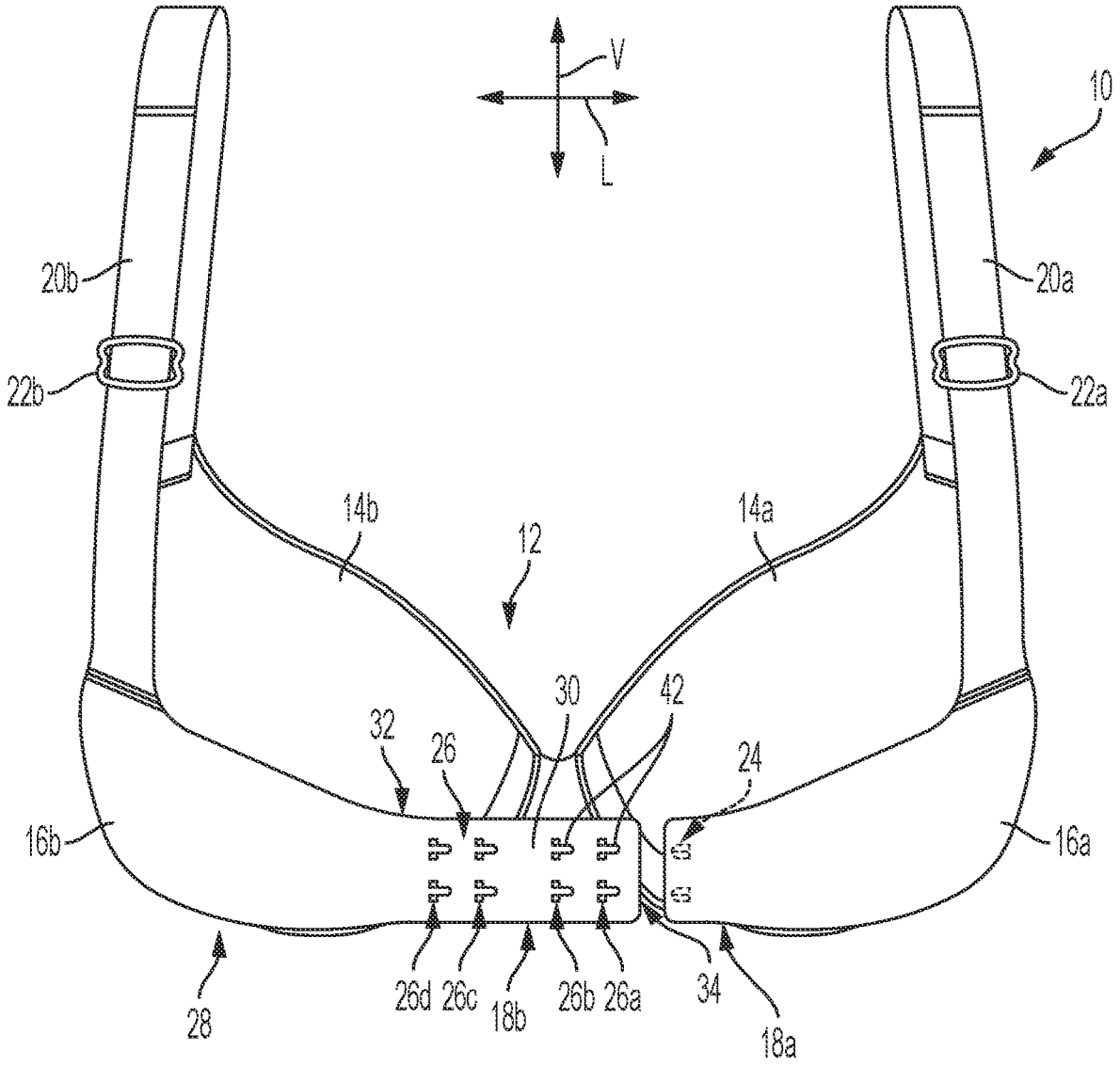
FIG. 1 illustrates one example of a brassiere according to the present disclosure.

FIG. 1 illustrates a brassiere 10 according to one example of the present disclosure. As is known, the brassiere 10 includes a chest-covering portion 12 including cups 14*a*, 14*b*. Instead of the molded cups 14*a*, 14*b* shown herein, the brassiere 10 could instead include a chest-covering portion that comprises a single panel of fabric, with or without defined cups provided therein. Thus, the chest-covering portion 12 shown here is not meant to be limiting on the scope of the present disclosure, and it should be understood that the closure portions described herein below can be used with lingerie, sport, or lounge brassieres or bralettes, and can be sized according to a cup and band system (e.g., 32A, 32B, 32C, 34A, 34B, 34C, etc.), according to an alpha system (e.g., S (small), M (medium), L (large), XL (extra-large), etc.), or according to a novel hybrid band-size and alpha-size system (32/34 S, 32/34 M, 32/34 L, 36/38 S, 36/38 M, etc.), as will be described further herein below.

A first wing 16*a* extends from a first side of the chest-covering portion 12 (more specifically, from the first cup 14*a*) and terminates at a first closure portion 18*a*. A second wing 16*b* extends from an opposite, second side of the chest-covering portion 12 (more specifically, from the second cup 14*b*) and terminates at a second closure portion 18*b*. Although the first and second closure portions 18*a*, 18*b* are shown herein as being provided integrally with (i.e., as part of the fabric of) the wings 16*a*, 16*b*, respectively, it should be understood that the first and second closure portions 18*a*, 18*b* could instead be provided such that they are sewn, adhered, bonded, or otherwise attached to the respective ends of the first and second wings 16*a*, 16*b*.

Straps 20*a*, 20*b* couple upper portions of the respective wings 16*a*, 16*b* to upper portions of the chest-covering portion 12, specifically at upper edges of cups 14*a*, 14*b*. The straps 20*a*, 20*b* include sliders 22*a*, 22*b* which allow for adjustment of the length of the straps 20*a*, 20*b*, as is known. In other examples, the straps 20*a*, 20*b* do not have sliders providing adjustable length. In still other examples, the straps 20*a*, 20*b* are configured differently than that shown herein, such as in an X-shaped back, a V-shaped back, a racer back, or in any known strap configuration. In still other examples, the brassiere 10 is a strapless brassiere.

Figure 8:
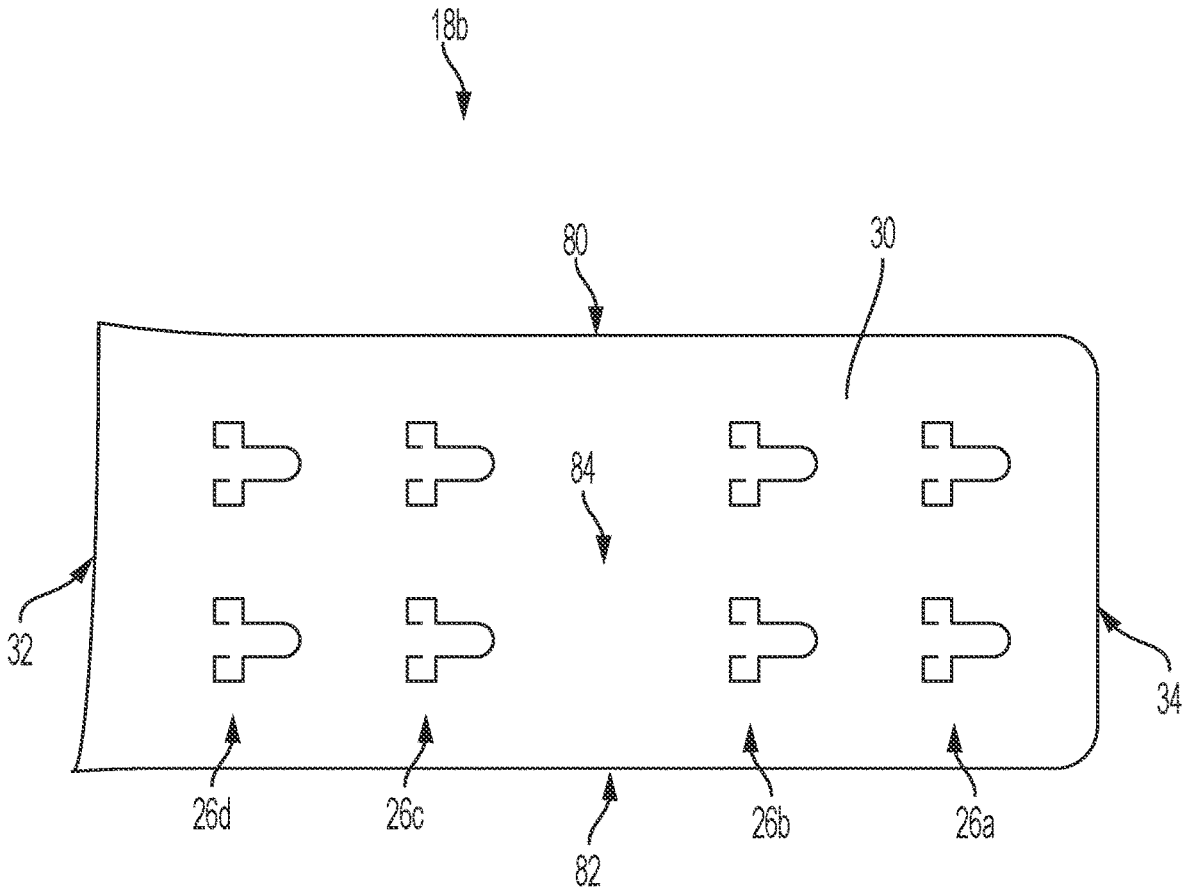
FIG. 8 illustrates a detailed view of a closure portion of the brassiere shown in FIG. 1.

Still referring to FIG. 1, a plurality of hooks 24 is provided on the first closure portion 18*a* on a face thereof that is configured to face the wearer's skin when the brassiere 10 is worn. Here, the brassiere 10 is shown from the back, and the hooks 24 on the skin-facing side are therefore shown in phantom, it being understood that they would not be able to be seen from the back view. A plurality of eyes 26 are provided on the second closure portion 18*b* on a face thereof that faces away from the wearer's skin. As in known, the plurality of eyes 26 are configured to engage with the plurality of hooks 24 to couple the first and second closure portions 18*a*, 18*b* together. This is accomplished by way of the plurality of hooks 24 being spaced in a vertical direction "V" by a vertical spacing that is the same as a vertical spacing between eyes in the plurality of eyes 26. By attaching the plurality of hooks 24 to a set of eyes in the plurality of eyes 26, a size (i.e., circumference) of the ribcage-encircling portion 28 of the brassiere 10 can be adjusted. To allow for such adjustment, the plurality of eyes 26 are arranged in a first column of eyes 26*a* next to a second column of eyes 26*b* and a third column of eyes 26*c* next to the second column of eyes 26*b* and a fourth column of eyes 26*d* next to the third column of eyes 26*c*. As will be described further herein below, a first lateral spacing in a lateral direction "L" is provided between the first and second columns of eyes 26*a*, 26*b*. This first lateral spacing is different from a second lateral spacing between the second and third columns of eyes 26*b*, 26*c*. Additionally, the third and fourth columns of eyes 26*c*, 26*d* are also separated by the first lateral spacing. Referring briefly to FIG. 8, the second closure portion 18*b* includes opposing upper and lower edges 80, 82, respectively, and the second closure portion 18*b* includes a gap portion 84 entirely defined by the outermost face (i.e., outer face 30) of the second closure portion 18*b* between the upper and lower edges 80, 82 and between the second column of eyes 26*b* and the third column of eyes 26*c*.

The closure portion 18*b* for the brassiere 10 includes an inner face configured to contact the wearer's skin while the brassiere 10 is worn. Although the inner face is not shown herein, one having ordinary skill in the art would understand that the inner face is on the opposite side of the closure portion 18*b* shown here. The closure portion 18*b* further includes an outer face 30 configured to face away from the wearer's skin while the brassiere 10 is worn. A first end 32 of the closure portion 18*b* is configured to be attached to the second wing 16*b* of the brassiere 10. A free second end 34 is situated opposite the first end 32. The plurality of eyes 26 are provided on the outer face 30 and are arranged in the above-noted first column of eyes 26*a* next to the second column of eyes 26*b*, the third column of eyes 26*c* next to the second column of eyes 26*b*, and the fourth column of eyes 26*d* next to the third column of eyes 26*c*.

As can further be understood from FIG. 1, the plurality of hooks 24 are on an inner face of the first closure portion 18*a*. Although the inner face is not shown, one having ordinary skill in the art would understand that the inner face is opposite the face shown in FIG. 1, and is configured to face towards the wearer's skin while the brassiere 10 is worn. As noted herein above, the plurality of eyes 26 is on an outer face 30 of the second closure portion 18*b* that is configured to face away from the wearer's skin while the brassiere 10 is worn. In this way, the plurality of hooks 24 can be connected to one of the columns of eyes, 26*a*, 26*b*, 26*c*, 26*d* to adjust the size of the ribcage-encircling portion 28 and accommodate wearers having different sized rib cages.

Although the hooks 24 and columns of eyes 26*a-d* are shown herein with two vertically spaced hooks/eyes in each column, in other examples, one, three, or four hooks/eyes can be provided in a single column. For example, one hook/eye per column may be appropriate on a smaller sized bra, while three or four vertically spaced hooks/eyes per column may be desirable for a larger sized bra. Such differential in hook/eye number per column is well known in the art.

Now turning to FIGS. 2 and 3, two examples of how the different first and second lateral spacings can be provided between the columns of eyes 26*a-d* in the plurality of eyes 26 will be described. As shown in both FIGS. 2 and 3, a first lateral spacing L1 is provided between the eyes in the first and second columns of eyes 26*a*, 26*b* and between the eyes in the third and fourth columns of eyes 26*c*, 26*d*. Note that although the first lateral spacing L1 is shown as being measured between seamlines 36 that attach the eyes to an eye tape 38*a*, 38*b* or 38*c*, the lateral spacing could instead be measured from any portion of the eyes in one column to any portion of the eyes in another column. As noted hereinabove, a second lateral spacing L2 is provided between the second and third columns of eyes 26*b*, 26*c*. Again, note that although the second lateral spacing L2 is shown as being measured between the seamlines 36 that attach the second and third columns of eyes 26*b*, 26*c* to the eye tapes 38*a*, 38*b* or 38*c*, the second lateral spacing L2 could be measured from any portion of the eyes in one column to any portion of the eyes in the other column. However, note that for comparison purposes, the lateral spacings L1, L2 should be measured from consistent portions of the eyes such that a like-to-like comparison can be made between the first lateral spacing L1 and the second lateral spacing L2. That is, if the first lateral spacing L1 is measured from the seamline 36 of the first column of eyes 26*a* to the seamline 36 of the second column of eyes 26*b*, the second lateral spacing L2 should be measured from the seamline 36 of the second column of eyes 26*b* to the seamline 36 of the third column of eyes 26*c*. As noted, the measurements could instead be made between different portions of the eyes 26, such as between the anchor ends 40 of the eyes 26 in one column to the anchor ends 40 of the eyes 26 in another column, or from the hook-receiving ends 42 of the eyes 26 in one column to the hook-receiving ends 42 of the eyes 26 in another column.

Figure 2:
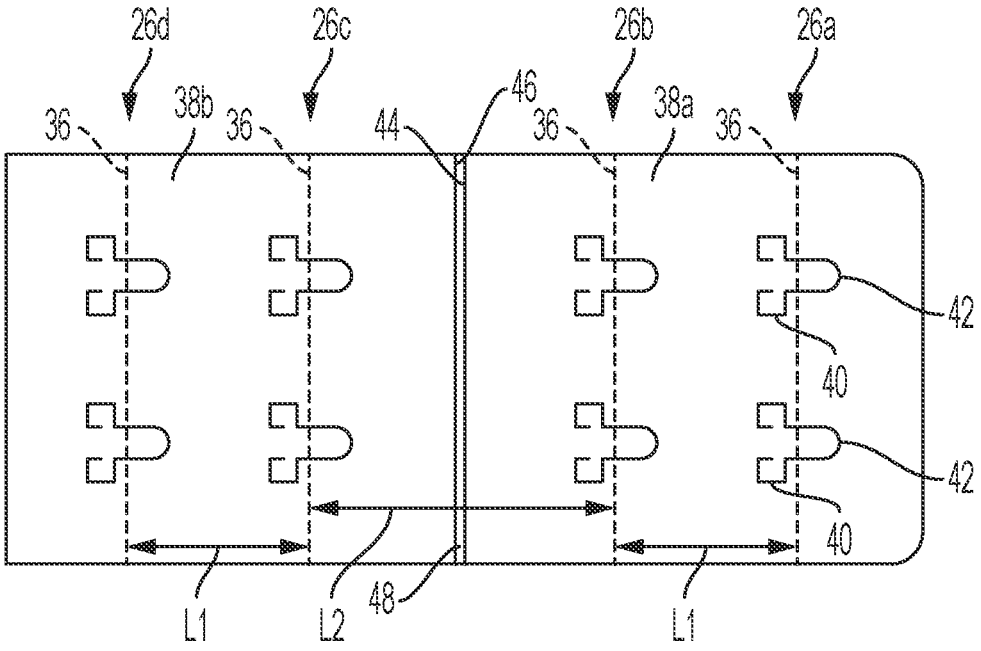
FIG. 2 illustrates one example of an eye tape according to the present disclosure.
Figure 3:
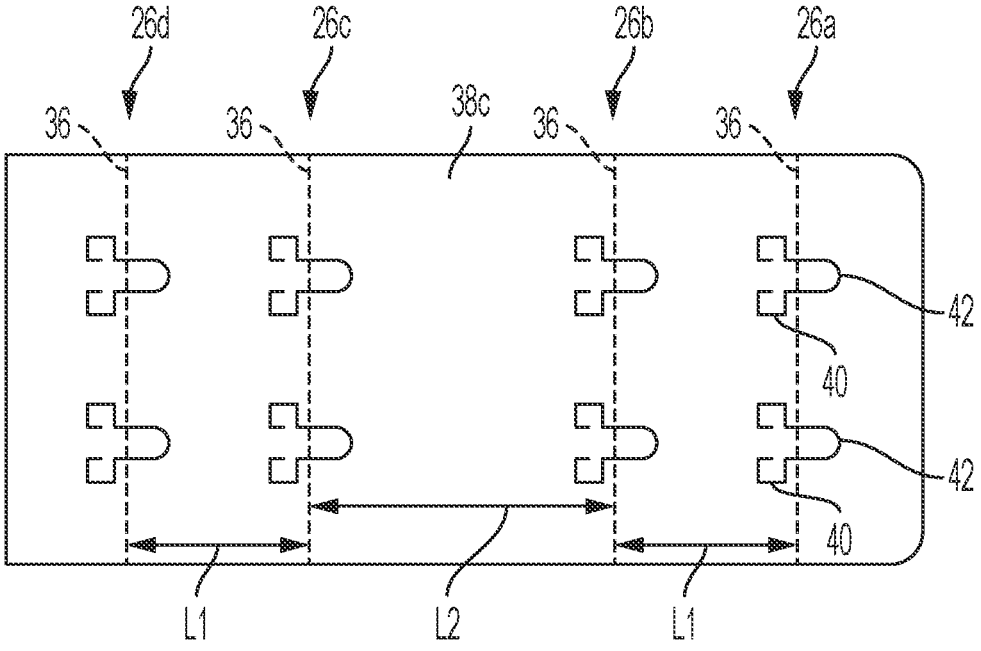
FIG. 3 illustrates another example of an eye tape according to the present disclosure.

As can be seen from examination of FIGS. 2 and 3, the second lateral spacing L2 is greater than the first lateral spacing L1. In some examples, the second lateral spacing L2 is between about 1.3 to 1.8 times the first lateral spacing L1. In some examples, the second lateral spacing L2 is greater than 1.5 times the first lateral spacing L1. In a specific example, the second lateral spacing is about 1.7 times the first lateral spacing L1, ±10%. Such exemplary relationships between the first and second lateral spacings L1, L2 provides a greater band size range for the ribcage-encircling portion 28, thereby allowing wearers of different band sizes to wear the same size brassiere 10 and/or allowing a single wearer whose band size changes (as the wearer gains or loses weight or as the ribcage-encircling portion 28 stretches between washes or over time) to wear a single brassiere 10. For example, if the first and second columns of eyes 26*a*, 26*b* are provided at a location for a wearer who would normally wear a 34 band size, the third and fourth columns of eyes 26*c*, 26*d* could be provided at a location for a wearer who would normally wear a 32 band size. Similarly, the brassiere 10 could be worn by a wearer of either a 34 or 36 band size, and so on through each known band size. Such graded spacing also allows for an alpha-sized bra to have more flexibility with respect to band size relative to the size of the chest-covering portion 12, as will be discussed further herein below.

Note that because the spacing L2 is greater than the spacing L1, the present arrangement of the plurality of eyes 26 provides advantages over known arrangements with three or more columns of eyes in which the same spacing is provided between each column of eyes. In such known arrangements, a wearer of a particular size of band can adjust the band only by the increments provided for that band size. For example, if she is a size 34, the equal spacing of eyes in known arrangements provides only for adjustments within the 34 band size range (e.g., from about 34" circumference to about 35.5" circumference of the ribcage-encircling portion 28), but does not allow her to effectively transition to a 32 or 36 band size. In contrast, the graded spacing of the columns of eyes in the present disclosure provides her with at least two choices for adjustment in at least two different band sizes, which choices would not be available if three or four columns of eyes were provided having the same lateral spacing between each column. By way of particular example, if the lateral spacing L1 is 14 mm and the lateral spacing L2 is 24 mm, a hypothetical third column of eyes to the left of the second column of eyes 26*b* at the equal lateral spacing L1 of 14 mm (as in known arrangements) would be 10 mm to the right of where the third column of eyes 26*c* is located in the present closure portion 18*b*. A hypothetical fourth column of eyes to the left of the hypothetical third column of eyes also at the equal lateral spacing L1 of 14 mm would be 4 mm to the left where the third column of eyes 26*c* is located in the present closure portion 18*b*. Thus, a true "sized-down" fit to a size 32 band would not be provided by three or four columns of eyes that are each spaced at the equal lateral spacing L1 from one another.

As can also be seen from FIGS. 2 and 3, the eyes in the first, second, third, and fourth columns of eyes 26*a-d* each have anchor ends 40 connected to the eye tape 38*a*, 38*b* or 38*c*. The first, second, third, and fourth columns of eyes 26*a-d* each also have hook-receiving ends 42 opposite the anchor ends 40. Although the anchor ends 40 and hook-receiving ends 42 are labeled only in the first column of eyes 26*a*, it should be understood that these anchor ends 40 and hook-receiving ends 42 are present in each of the second, third, and fourth columns of eyes 26*b-d*. Thus, it can be seen from FIG. 2 that the first and second columns of eyes 26*a*, 26*b* each have anchor ends 40 connected to the first eye tape 38*a*, and the eyes in the third and fourth columns of eyes 26*c*, 26*d* each have anchor ends 40 connected to the second eye tape 38*b*. As noted hereinabove, the eyes in the plurality of eyes 26 are connected to the eye tapes 38*a*, 38*b* or 38*c* at seamlines 36, such as by sewing. In other examples, the eyes in the plurality of eyes 26 can be stitched, fused, bonded, glued, adhered, riveted, or otherwise connected to the eye tapes 38*a-c* by known methods.

Comparison of FIG. 2 with FIG. 3 illustrates two different ways to achieve the differential in spacing between the first and second columns of eyes 26*a*, 26*b* and the second and third columns of eyes 26*b*, 26*c* using eye tapes 38*a*, 38*b* or 38*c* to which eyes 26 have already been attached.

In the example of FIG. 2, first and second eye tapes 38*a*, 38*b*, each having typical spacing (e.g., first lateral spacing L1) between the columns of eyes as known to those having skill in the art, are situated laterally end-to-end and are coupled together in this arrangement, with enough fabric provided at the adjacent ends 44, 46 of the eye tapes 38*a*, 38*b* that more than the first lateral spacing L1 is provided between the second column of eyes 26*b* and the third column of eyes 26*c*. More specifically, first eye tape 38*a* and second eye tape 38*b* are laid onto a piece of fabric, such as inner layer of fabric 52 (FIG. 4) or a separate stabilizer fabric, such that end 44 of first eye tape 38*a* is situated adjacent end 46 of second eye tape 38*b*. The end-to-end eye tapes 38*a*, 38*b* can be bonded to the piece of fabric in any known manner, such as by lamination using sprayed, screen-printed, tape, or mesh adhesive between the eye tapes 38*a*, 38*b* and the piece of fabric and subsequent application of heat to the layered assembly. Alternatively, the eye tapes 38*a*, 38*b* can be stitched, fused, bonded, glued, adhered, riveted, or otherwise connected to the piece of fabric. In other examples, prior to lamination (or other type of connection) with the piece of fabric, the first and second eye tapes 38*a*, 38*b* can be connected together at connection 48 by known methods, such as by sewing, by an adhesive, or by bonding or fusing. For example, the first and second eye tapes 38*a*, 38*b* that are situated laterally end-to-end may be ultrasonically bonded together along the respective adjacent ends 44, 46 thereof. Ultrasonic bonding, or sonic welding, utilizes high-frequency (ultrasonic) sound waves to hold together the two eye tapes 38*a*, 38*b* under pressure and fuse them into a single piece. Regardless of how they are coupled to one another, arrangement of the eye tapes 38*a*, 38*b* as shown in FIG. 2 allows for conventional eye tapes known to those having ordinary skill in the art to be used to form the closure portion 18*b* of the present disclosure.

Alternatively, as shown in FIG. 3, a single eye tape 38*c* could be provided, and the columns of eyes 26*a-d* could be attached thereto along seamlines 36 by sewing or by other known attachment methods, as described hereinabove, to provide the first lateral spacing L1 between the first and second columns of eyes 26*a*, 26*b* and between the third and fourth columns of eyes 26*c*, 26*d* and the second lateral spacing L2 between the second and third columns of eyes 26*b*, 26*c*. Special machinery may be needed in order to provide such spacing on a single eye tape 38*c*. In some examples (as described hereinabove with respect to the two eye tapes 38*a*, 38*b*), the single eye tape 38*c* is laminated, stitched, fused, bonded, glued, adhered, riveted, or otherwise connected to a piece of fabric, such as inner layer of fabric 52 (FIG. 4) or a separate stabilizer fabric, prior to its incorporation into the brassiere 10.

In either of the examples of FIG. 2 or 3, only three columns of eyes might be provided, with the first lateral spacing L1 between a set of two adjacent columns and the second lateral spacing L2 between a different set of two adjacent columns. Such an arrangement would provide two fit options for a first band size and one fit option for another band size. Alternatively, more than four columns of eyes could be provided, with the second lateral spacing L2 between the fourth column of eyes 26*d* and a fifth (or more) column(s) of eyes, so as to provide sizing in three or more band-size ranges. Note also that the definition of the columns of eyes as "first" through "fourth" starting from the right and working to the left could be reversed, and such definition is not limiting on the scope of the present disclosure.

Figure 4:
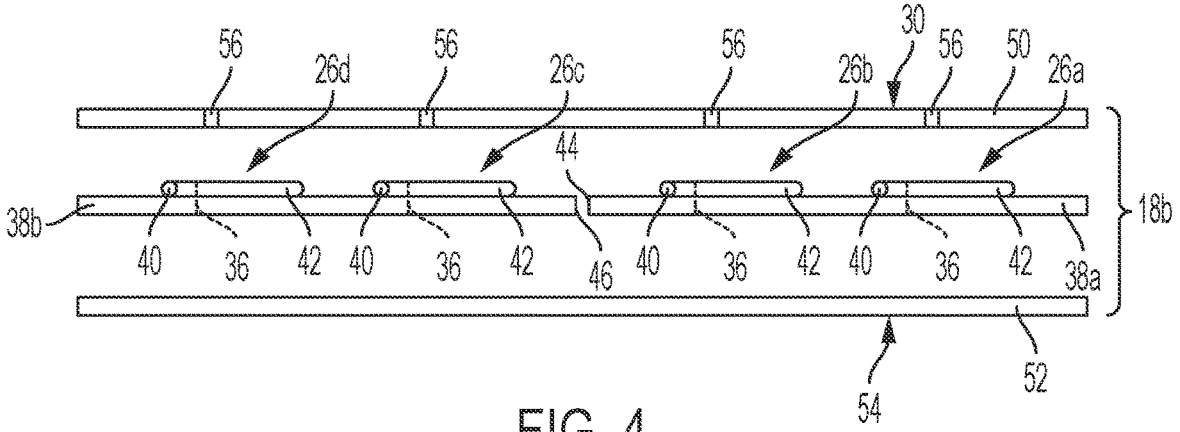
FIG. 4 illustrates one example of a number of layers for a portion of a closure according to the present disclosure, shown in exploded cross-section.
Figure 5:
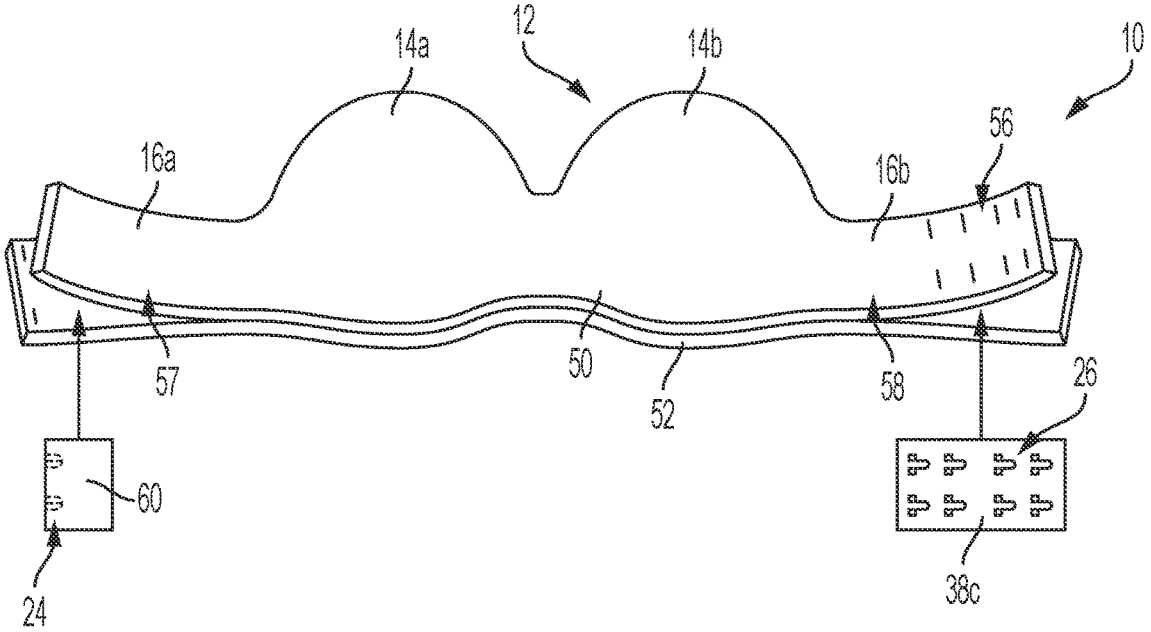
FIG. 5 illustrates the layers as they would be found in a portion of a brassiere according to the present disclosure.

Several different methods could be used to attach the eye tapes 38, 38*b* or 38*c* to the brassiere 10. Referring to FIGS. 4 and 5, the brassiere 10 may further include an outer layer of fabric 50 defining the outer face 30 of the second closure portion 18*b*. The brassiere 10 may further include an inner layer of fabric 52 defining an inner face 54 of the second closure portion 18*b*. As shown, the innermost face (i.e., inner face 54) of the second closure portion 18*b* is defined by a continuous, unitary layer (i.e., inner layer of fabric 52) configured to lie between each of the first, second, third, and fourth columns of eyes 26*a-d* and the wearer's skin. FIG. 4 shows how the first eye tape 38*a* is sandwiched between the inner and outer layers of fabric 52, 50, and the second eye tape 38*b* is also sandwiched between the inner and outer layers of fabric 52, 50. Although FIG. 4 shows the two eye tapes 38*a*, 38*b*, it should be understood that if the single eye tape 38*c* of FIG. 3 were used, the eye tape 38*c* would be sandwiched between the inner and outer layers of fabric 52, 50 in the same manner. See, for example, FIG. 5.

Returning to FIG. 4, as was noted hereinabove, each of the eyes in the columns of eyes 26*a-d* has an anchor end 40 connected to the eye tapes 38*a*, 38*b* such as along seamlines 36. The hook-receiving ends 42 extend through corresponding apertures 56 (see also FIG. 5) in the outer layer of fabric 50 so as to lie on the outer face 30 of the closure portion 18*b*. Although FIGS. 4 and 5 do not show the hook-receiving ends 42 extending through the apertures 56, FIG. 1 shows what the final product would look like when the hook-receiving ends 42 have been inserted through the apertures 56 to lay on the outer face 30 of the second closure portion 18*b*. As shown in FIG. 5, the apertures 56 can be slits cut into the outer layer of fabric 50, such as by laser cutting, ultrasonic cutting/bonding, or another known method.

To form the closure portion 18*b* of FIG. 4, the eye tapes 38*a*, 38*b* may be situated end-to-end on the inner layer of fabric 52, with adhesive provided between the eye tapes 38*a*, 38*b* and the inner layer of fabric 52. The eye tapes 38*a*, 38*b* could be connected together at connection 48 (FIG. 2) before they are laid on the inner layer of fabric 52, or the eye tapes 38*a*, 38*b* could be separate from one another when they are laid on the inner layer of fabric 52 (FIG. 4). Heat may then be applied to activate the adhesive and laminate (bond) the eye tapes 38*a*, 38*b* to the inner layer of fabric 52. The outer layer of fabric 50 may then be placed on top of the eye tapes 38*a*, 38*b*, with a layer of adhesive between the eye tapes 38*a*, 38*b* and the outer layer of fabric 50. Heat is then applied to laminate (bond) the outer layer of fabric 50 to the layered eye tapes 38*a*, 38*b* and inner layer of fabric 52, thereby making the closure portion 18*b* a unitary component. The apertures 56 can then be cut (for example, ultrasonically) through the outer layer of fabric 50 and the hook-receiving ends 42 of the eyes pulled through the apertures 56. Alternatively, the apertures 56 can be cut prior to assembly and the hook-receiving ends 42 of the eyes can be pulled through the apertures 56 before the outer layer of fabric 50 and eye tapes 38*a*, 38*b* are bonded together. In some examples, additional materials can be sewn, adhered, bonded, or otherwise inserted into the closure portion 18*b*, such as a stabilizer layer (e.g., polymer mesh, 100% polyester knit fabric) or a cushioning layer (e.g., foam, terry knit fabric, fiberfill), which would generally be included between the inner layer of fabric 52 and the eye tapes 38*a*, 38*b* or 38*c*.

As shown in FIG. 5, the outer layer of fabric 50 can be integral with (defines) an outer face 57 of the first wing 16*a* and an outer face 58 of the second wing 16*b*. FIG. 5 shows how the brassiere 10 of the present disclosure might be assembled, such as by molding a single outer layer of fabric 50 and a single inner layer of fabric 52 together to form both the cups 14*a*, 14*b* of the chest-covering portion 12 and the wings 16*a*, 16*b*, while leaving the outer layer of fabric 50 and inner layer of fabric 52 unattached at the ends of the wings 16*a*, 16*b*. The eye tape 38*c*, complete with the plurality of eyes 26 arranged in the above-noted columns of eyes, may then be placed between the unattached layers of fabric 50, 52 at the end of the second wing 16*b*, and the hook-receiving ends 42 may be inserted through the apertures 56 in the outer layer of fabric 50. Similarly, a hook tape 60 with the plurality of hooks 24 attached thereto could be inserted between the outer layer of fabric 50 and the inner layer of fabric 52 at the end of the first wing 16*a*. The hooks 24 are inserted through corresponding apertures 63 in the inner layer of fabric 52 so as to lie on the inner face 54 thereof. The layers of fabric 50, 52 at the ends of the wings 16*a*, 16*b* can be sewn, adhered, laminated, and/or further molded together to seal the eye tape 38*c* and hook tape 60 there between, such as described herein above with respect to FIG. 4. Furthermore, the eye tapes 38*a* and 38*b* can be used in place of the eye tape 38*c* in the assembly shown in FIG. 5.

Note that although straps 20*a*, 20*b* are not shown in FIG. 5, which represents the brassiere 10 during an unfinished stage of manufacturing, the straps 20*a*, 20*b* could later be provided as shown in FIG. 1. Note also that, in other examples, the wings 16*a*, 16*b* and cups 14*a*, 14*b* need not be integral with one another, but could instead be cut and sewn or bonded together. Additionally, it should be understood that if the first and second eye tapes 38*a*, 38*b* of FIG. 2 are used in the brassiere 10, they need not be connected end-to-end prior to their insertion between the inner and outer layers of fabric 52, 50 and attachment thereto. However, prior attachment of the first and second eye tapes 38*a*, 38*b* together end-to-end may provide a stronger closure portion 18 and/or may make the brassiere 10 easier to assemble. It should also be noted that although the closure portions 18*a*, 18*b* are shown herein as being integral with the ends of the wings 16*a*, 16*b*, respectively, the closure portions 18*a*, 18*b* could be manufactured separately from the remainder of the brassiere 10 and later connected to the terminal ends of the wings 16*a*, 16*b*, respectively, by stitching, sewing, ultrasonic bonding, adhering, gluing, or any combination of these attachment methods. In one particular example in which the closure portion 18*b* is manufactured separately from the brassiere 10, the inner layer of fabric 52 is placed over the outside of the outer layer of fabric 50 (i.e., on the side of the outer layer of fabric 50 opposite the eye tapes 38*a*, 38*b* or 38*c*) and connected (such as ultrasonically welded or sewn) to the perimeter of the outer layer of fabric 50 except at one end, such as the end closest to the fourth column of eyes 26*d*. The inner layer of fabric 52 is then folded inside-out around the assembly to cover the eye tape(s) 38*a*, 38*b* or 38*c*. Finally, those skilled in the art would recognize that the brassiere 10 could include layers in addition to the outer and inner layers of fabric 50, 52, such as additional layers of fabric, foam, fiberfill, mesh/netting, and/or plastic or metal support components.

Figure 6:
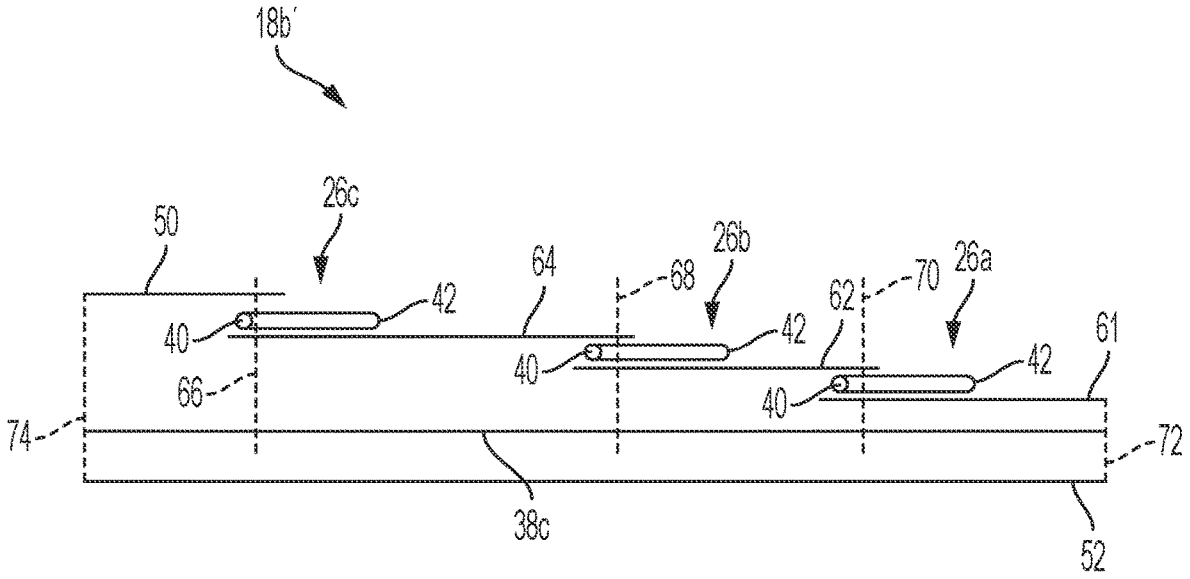
FIG. 6 illustrates another example of a number of layers for a closure according to the present disclosure, shown in exploded cross-section.

FIG. 6 illustrates an alternative arrangement for connecting the plurality of eyes 26 to a brassiere. In this example of a closure portion 18*b*', the anchor ends 40 of the eyes in the plurality of eyes 26 are still connected to the eye tape 38*c*; however, the hook-receiving ends 42 do not extend through apertures in the outer layer of fabric 50. Rather, separate outer layers of fabric 61, 62, 64 are layered between each column of eyes in the plurality of eyes 26. For example, a first separate outer layer of fabric 61 covers the eye tape 38*c* and extends under the eyes in the first column of eyes 26*a*. A second separate outer layer of fabric 62 is layered between the eyes in the first column of eyes 26*a* and the eyes in the second column of eyes 26*b*. A third separate outer layer of fabric 64 is layered between the eyes in the second column of eyes 26*b* and the eyes in the third column of eyes 26*c*. The eye tape 38*c* is still provided between the inner layer of fabric 52 and the outer layer of fabric 50, which is provided over the anchor ends 40 of the eyes in the third column of eyes 26*c*. Note that although the fourth column of eyes 26*d* is not shown herein, it could be provided next to the third column of eyes 26*c* as disclosed herein above, with an additional separate outer layer of fabric provided between the third column of eyes 26*c* and the fourth column of eyes 26*d*. Additionally, note that although the eye tape 38*c* of FIG. 3 is shown in this example, the eye tapes 38*a*, 38*b* of FIG. 2 could instead be provided.

In the example of FIG. 6, the outer layer of fabric 50 can be sewn along seamline 66 to the eyes in the third column of eyes 26*c*, to one end of the separate outer layer of fabric 64, and to the eye tape 38*c*. The other end of the separate outer layer of fabric 64 can be sewn to the eyes in the second column of eyes 26*b*, to one end of the separate outer layer of fabric 62, and to the eye tape 38*c* along seamline 68. The other end of the separate outer layer of fabric 62 can be sewn to the eyes in the first column of eyes 26*a*, to the separate outer layer of fabric 61, and to the eye tape 38*c* along seamline 70. The seamlines 66, 68, 70 (which are shown schematically) could extend through to the inner layer of fabric 52, or the inner layer of fabric 52 could be sewn, bonded, or otherwise attached to the assembly in a later step, in order to provide a seamless inner face to the closure portion 18*b*'. For example, the closure portion 18*b*' could be finished at its ends by bonding, fusing, sewing, or other known finishing methods that connect the inner layer of fabric 52 to the outer layer of fabric 61 at finished edge 72 and to the outer layer of fabric 50 at finished edge 74. Note that the outer layers of fabric 61, 62, 64, 50 could be folded over at their exposed ends to provide a clean look to the closure portion 18*b*', although such folding is not shown herein for purposes of clarity. In some exemplary methods, the eye tape 38*c*, eyes 26, and layers of fabric 61, 62, 64, 50 are sewn together before being connected to the inner layer of fabric 52. The inner layer of fabric 52 is then placed on top of the eyes 26 and layers of fabric 61, 62, 64, 50 and bonded or sewn thereto around the edges, and the assembly is thereafter turned inside-out to achieve the configuration of FIG. 6. Further layers, such as foam layers, stabilizer layers, or additional fabric layers, can be provided between the eye tape 38*c* and the inner layer of fabric 52. These additional layers can be sewn to the bottom of the eye tape 38*c* and to the eyes 26 and layers of fabric 61, 62, 64, 50 before all layers are connected around their edges to the inner layer of fabric 52, and the assembly is thereafter turned inside-out. For some examples of how this could be accomplished, see U.S. Pat. Nos. 6,820,312 and 7,918,711.

Thus, FIG. 6 shows a closure portion 18*b*' having outer layers of fabric 61, 62, 64, 50 defining its outer face and an inner layer of fabric 52 defining its inner face. An eye tape 38*c* is sandwiched between the inner layer of fabric 52 and the outer layers of fabric 61, 62, 64, 50. The eyes 26 in the first, second, and third columns of eyes 26*a*-*c* each have anchor ends 40 connected to the eye tape 38*c* and hook-receiving ends 42 opposite the anchor ends 40. The anchor ends 40 of the eyes 26 are covered by a respective one of the outer layers of fabric 61, 62, 64, or 50, while the hook-receiving ends 42 of the eyes 26 lie on an outer surface of another respective one of the outer layers of fabric 61, 62, 64, or 50. For example, the anchor ends 40 of the eyes in third column of eyes 26*c* are covered by the outer layer of fabric 50, while the hook-receiving ends 42 of the eyes in third column of eyes 26*c* lie on the outer surface of the outer layer of fabric 64.

The closure portion 18*b*' shown in FIG. 6 could be manufactured as a separate pre-assembled piece that is later sewn to the end of the second wing 16*b*, or could be provided as an integral part of the brassiere 10, such as if the inner layer of fabric 52 is the inner layer of fabric of the wings 16*a*, 16*b* (and perhaps even the cups 14*a*, 14*b*), and/or the outer layer of fabric 50 is the outer layer of fabric of the wings 16*a*, 16*b* (and perhaps even the cups 14*a*, 14*b*). Similarly, as noted hereinabove, the closure portion 18*b* of FIG. 4 could be a separately manufactured sub-assembly that is later sewn or otherwise attached at the end closest to the fourth column of eyes 26*d* to the end of the second wing 16*b*. In some instances, the end closest to the fourth column of eyes 26*d* can be left open (i.e., provided with two flaps) to allow for insertion of the end of the wing 16*b* therein, after which the end of the wing 16*a* and the pre-assembled closure portion 18*b*, 18*b*' can be connected by one of the above-noted methods. For one example, see International Application Publication No. WO2014/174332.

Note that in the examples of FIGS. 4 and 5, the eyes 26 can be pre-attached to the eye tapes 38*a*, 38*b* or 38*c* (such as by sewing), after which the eye tapes 38*a*, 38*b* or 38*c* with the pre-attached eyes can be placed between two layers of fabric 50, 52 and the hook-receiving ends 42 of the eyes 26 pulled through the apertures 56. However, in the example of FIG. 6, the eyes 26 are provided separately from the eye tape 38*c* and then layered with the outer layers of fabric 61, 62, 64, 50 and sewn thereto. This is because the outer layers of fabric 61, 62, 64, 50 overlap with one another and are located between the eyes 26 and the eye tape 38*c*. In this way, the eye tape 38*c* acts as a stabilizer fabric to which the eyes 26 are attached. In other examples, no eye tapes 38*a-c* are used at all, and the eyes 26 can be sewn or otherwise attached directly to the inner layer of fabric 52 of the brassiere 10 or sewn or otherwise attached directly to a base/inner layer of fabric of a separately pre-assembled closure portion.

The fabrics of which the brassiere 10 is made are those known in the art for such purposes. The inner and outer layers of fabric 52, 50 could be cotton, polyester, nylon, spandex, and/or blends thereof. The eye tape 38*a*, 38*b* or 38*c* could be nylon, polyester, cotton, and/or blends thereof, and in some examples is made of a material and fabricated in such a way that it has little or no stretch. For example, the eye tapes 38*a-c* can be made of known stabilizer materials, such as non-stretch or low stretch knits, wovens, or meshes. The inner and outer layers of fabric 52, 50 can be laminated and/or molded to one another by methods known to those having ordinary skill in the art, such as by way of a polyurethane hot adhesive melt. Alternatively, the inner and outer layers of fabric 52, 50 could be sewn and/or bonded to one another along their edges.

The closure portions 18*b*, 18*b*' described above can be used to create a collection of brassieres sized according to a novel hybrid sizing system, in which each cup size is associated with at least two band sizes. Current alpha sizing systems (e.g., brassieres sized according to S, M, L, etc.) often include a chart associated with the brassieres that tells a buyer what alpha size she should purchase based on her cup and band size. For example, a known alpha sizing chart may equate sizes 34AA, 34A, 34B, 32C, and 32D with size small (S), while sizes 36A, 36B, 34C, and 34D are equated to size medium (M). These charts are based on a trade-off between ribcage circumference and breast volume that occurs when translating a cup-and-band size to an alpha size and are often unique to a particular brand's products. Known alpha size conversion charts may have a few given alpha sizes in which a single cup size is associated with two band sizes, but often, as band size increases, so does alpha size. This means that a wearer may be forced to size-up or size-down in alpha size, resulting in less than an ideal fit, especially if the wearer has a large cup size and small band size or a large band size and a small cup size. In some instances, a wearer's cup and band size is not even covered by a given alpha size conversion chart. Thus, the present inventors recognized that providing a hook and eye closure with columns of eyes spaced at locations that would provide two different "traditional" band size options with a single closure would provide increased sizing flexibility, allowing a collection of brassieres to fit more wearers of an increased size range, with fewer unique products needing to be manufactured (i.e., fewer stock keeping units (SKUs)).

The above-noted trade-off between ribcage circumference and breast volume that occurs when converting cup-and-band size to alpha size is a byproduct of the typical structure of cup-and-band bras versus the typical structure of alpha bras.

Typical cup-and-band sized bras are constructed in a manner suggested by their name: fabric and/or foam and/or other suitable materials are provided to form two breast cups, which may be connected by a center gore or may be molded in a single front panel, and which are designed by way of molding and/or provision of a necessary amount of fabric to have a volume that is capable of holding a certain size of a wearer's breasts. The breast cups are attached to wings, one on either side, that are intended to extend under a wearer's arms and around her back, forming a "band" around the wearer. A hook and eye closure can be used to provide variation to the combined circumference of the cups, gore, and wings, which allows for adjustments to fit as a bra stretches between washes and over time. Typically, eyes are provided in three or four columns and provide a total of 1.5-1.75 inches of variation in the circumference of the band. As noted above, known eye closure portions space the columns of eyes at equal distances from each other. A wearer can determine the correct size of cup-and-band bra by measuring around her ribcage below her breasts and measuring around the fullest part of her breasts, in line with the nipples. The difference between the two measurements is then used to calculate a cup size, while the band size is based on the measurement around the ribcage. (Note that for some brands, the ribcage measurement directly translates to band size, while other brands add length to the ribcage measurement to determine the band size.) Generally, bra bands are sized in increments (e.g., in the US and UK in increments of two inches, and in most of mainland Europe and Asia in increments of five centimeters) and if a woman's ribcage measurement falls between these increments, she is advised to round down to the closest band size.

In contrast, alpha-sized bras are often manufactured without separate cups, but instead with one panel or "sling" provided to accommodate both of the wearer's breasts. This front panel is typically not molded and is sewn or integral with a back panel of fabric, which is configured to extend under the wearer's arms and across her back, often without a closure. An elastic band is often sewn or otherwise attached around the bottom of the front and back panels and is configured to hold the bra tight to the wearer's ribcage under her breasts. Sometimes, the fabric of the bra is knitted differently in the under-breast area instead of an elastic band being provided. The alpha size of the bra is largely up to the convention of the manufacturer, with larger sizes generally corresponding to larger ribcage measurements and larger measurements at the fullest part of the breasts. The above-noted trade-off comes in, for example, when a woman with a large cup size and a small band size needs to select an alpha-size bra of a size larger than her band size alone would dictate in order to accommodate her breast volume. This may cause the bra to be too loose around her ribcage. Alternatively, if she selects an alpha-sized bra with a ribcage band that fits well, her breasts may overflow the fabric provided for the front panel. Meanwhile, a woman with a large band size and a smaller cup size may experience problems with fit at the other end of the spectrum, where a bra that fits around her ribcage is not supportive enough of her breasts, or a bra that fits snugly against her breasts is too tight around the ribcage.

Figure 7:
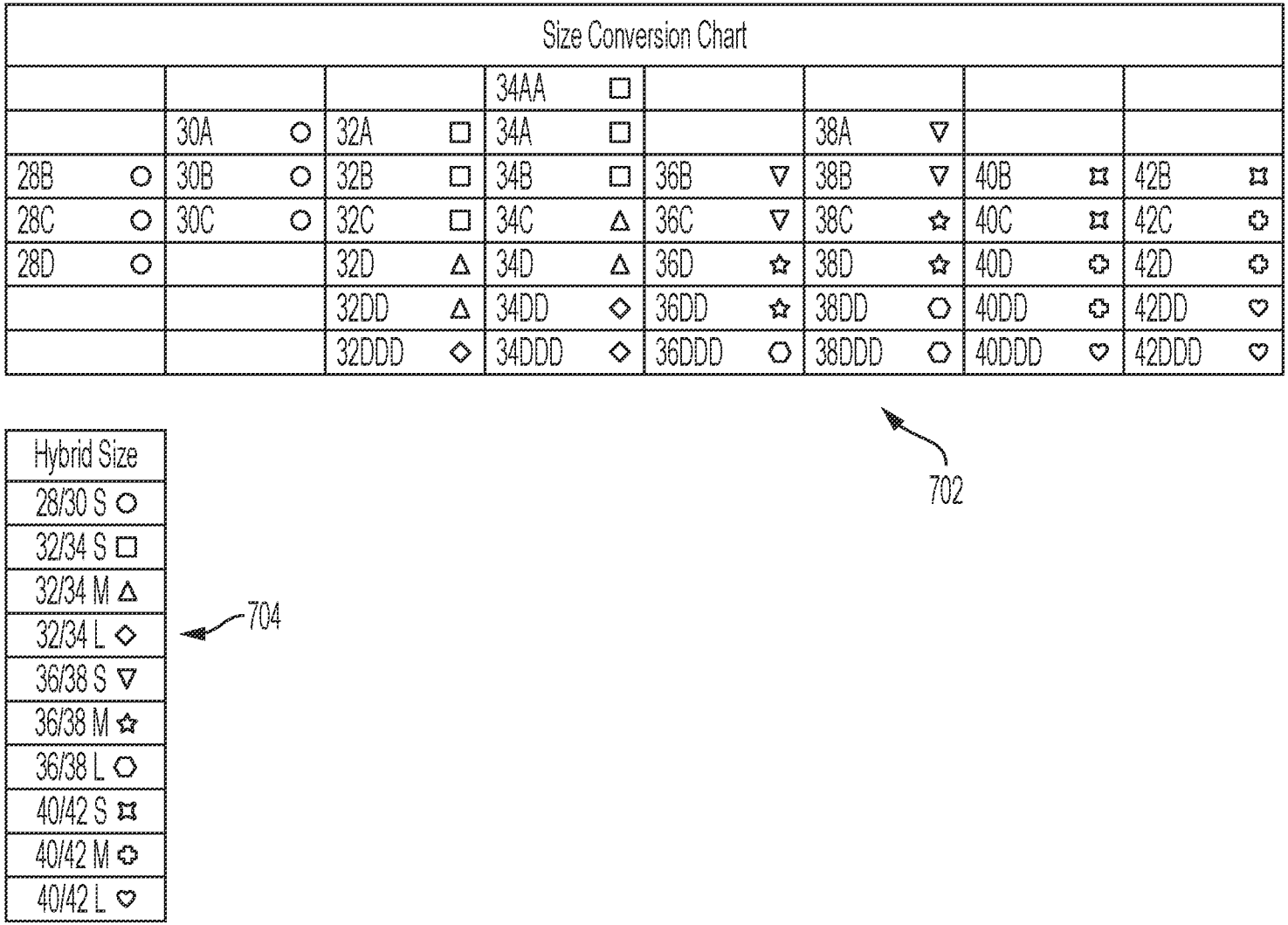
FIG. 7 shows a size conversion chart according to one example of the present disclosure.

Therefore, as noted above, the present inventors have developed a novel hybrid sizing convention in which, for any given nominal size of bra in the collection, there are at least two band sizes associated with each cup size, providing a wearer with more options to choose from for a better fit. Referring to FIG. 7, an exemplary size chart for converting a cup-and-band size measurement to a hybrid size is shown. The conversion chart 702 covers a multitude of cup-and-band size combinations, here 40 combinations. The key 704 shows how the conversion chart 702 correlates to 10 different hybrid sizes, in other words, 10 different brassieres or SKUs. It can be seen that each hybrid size covers at least two band sizes per cup size. For example, hybrid size 28/30 S covers band sizes 28 and 30 for cup size B, and covers band sizes 28 and 30 for cup size C. Hybrid size 32/34 S covers band sizes 32 and 34 for cup size A, and band sizes 32 and 34 for cup size B. Hybrid size 32/34 M covers band sizes 32 and 34 for cup size D. Hybrid size 32/34 L covers band sizes 32 and 34 for cup size DDD. Hybrid size 36/38 S covers band sizes 36 and 38 for cup size B. Hybrid size 36/38 M covers band sizes 36 and 38 for cup size D. Hybrid size 36/38 L covers band sizes 36 and 38 for cup size DDD. Hybrid size 40/42 S covers band sizes 40 and 42 for cup size B. Hybrid size 40/42 M covers band sizes 40 and 42 for cup size D. Hybrid size 40/42 L covers brand sizes 40 and 42 for DDD. The ability to provide two band sizes on a given bra by including the eye closure portion 18*b* or 18*b*' described in detail hereinabove thus allows for a collection bras that fit a wide range of wearers better than a traditional alpha-sized collection of bras would. For example, even at the high end of the cup-size range, a woman still has three hybrid sizes to choose from: 32/34 L, 36/38 L, and 40/42 L, covering six different band sizes. At the lower end of the cup-size range, a woman also has three hybrid sizes to choose from: 28/30 S, 32/34 S, and 36/38 S, covering four band sizes.

Note that the choice of S, M, L, etc. in the above hybrid sizing system is arbitrary, and the second portion of the hybrid size nomenclature could just as easily be represented using any other letters, numbers, or symbols. Note also that the use of two band sizes separated by a slash in the above hybrid sizing system is also arbitrary, and the first portion of the hybrid size nomenclature could just as easily be represented by any other numbers, letters, or symbols. Finally, note that because even cup-and-band sizes for bras vary across brands, the chart 702 and key 704 in FIG. 7 are merely exemplary, and it may be that different cup-and-band size combinations correspond to different hybrid sizes for a different brand. Additionally, the number of hybrid sizes (here, ten) is not limiting on the scope of the present disclosure, and it should be understood that there can be more hybrid sizes (for more size variation) or fewer hybrid sizes (for less size variation) depending on the manufacturer's choice. In general, however, at least as far as hybrid sizing is concerned, there would not be as many hybrid sizes as cup-and-band sizes, or the benefit of fewer SKUs would be lost.

Thus, the present disclosure is of a collection of brassieres provided in a plurality of brassiere sizes, wherein each given brassiere size in the plurality of brassiere sizes is configured such that for the given brassiere size, at least one volumetric breast cup size is associated with at least two ribcage encircling band sizes. Although the closure portions 18*b* and 18*b*' and hybrid sizing system described herein have particular applicability to sport and lounge bras and bralettes, they are equally applicable to lingerie-type bras. For example, note that the present closure portions 18*b* or 18*b*' could be used on a collection of brassieres that do have typical cup sizing (A, B, C, etc.), whereby two band sizes could be covered for each cup size, potentially reducing the number of SKUs by half.

In the above description, certain terms have been used for brevity, clarity, and understanding. No unnecessary limitations are to be inferred therefrom beyond the requirement of the prior art because such terms are used for descriptive purposes and are intended to be broadly construed. The different assemblies and methods described herein may be used alone or in combination with other assemblies and methods. It is to be expected that various equivalents, alternatives and modifications are possible within the scope of the appended claims.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A brassiere comprising:

a chest-covering portion;

a first wing extending from a first side of the chest covering portion and terminating at a first closure portion;

a second wing extending from an opposite, second side of the chest covering portion and terminating at a second closure portion;

a plurality of hooks on the first closure portion; and a plurality of eyes on the second closure portion configured to engage with the plurality of hooks to couple the first and second closure portions together;

wherein eyes in the plurality of eyes are arranged in a first column of eyes next to a second column of eyes, a third column of eyes next to the second column of eyes, and a fourth column of eyes next to the third column of eyes;

wherein a first lateral spacing between the first and second columns of eyes is different from a second lateral spacing between the second and third columns of eyes;

wherein the third and fourth columns of eyes are separated by the first lateral spacing;

wherein the plurality of eyes is on an outermost face of the second closure portion that is configured to face away from a wearer's skin while the brassiere is worn;

wherein the second closure portion has an innermost face opposite the outermost face, the innermost face being configured to face toward the wearer's skin while the brassiere is worn;

wherein the innermost face of the second closure portion is defined by a continuous, unitary layer configured to lie between each of the first, second, third, and fourth columns of eyes and the wearer's skin; and wherein the second closure portion includes opposing upper and lower edges, and wherein the second closure portion includes a gap portion entirely defined by the outermost face of the second closure portion between the upper and lower edges and between the second column of eyes and the third column of eyes.

2. The brassiere of claim 1, further comprising:

an outer layer of fabric defining the outermost face of the second closure portion;

an inner layer of fabric defining the innermost face of the second closure portion; and a first eye tape sandwiched between the inner and outer layers of fabric;

wherein the eyes in the first, second, third, and fourth columns of eyes each have anchor ends; and wherein the anchor ends of the eyes in at least one of the first, second, third, and fourth columns of eyes are connected to the first eye tape.

3. The brassiere of claim 2, further comprising a second eye tape sandwiched between the inner and outer layers of fabric;

wherein the anchor ends of the eyes in the first and second columns of eyes are connected to the first eye tape, and wherein the anchor ends of the eyes in the third and fourth columns of eyes are connected to the second eye tape; and wherein the first and second eye tapes are situated laterally end-to-end and are coupled together.

4. The brassiere of claim 2, wherein the eyes in the first, second, third, and fourth columns of eyes each have hook-receiving ends opposite the anchor ends, and wherein the hook-receiving ends extend through corresponding apertures in the outer layer of fabric so as to lie on the outermost face of the second closure portion.

5. The brassiere of claim 2, wherein the anchor ends of each of the eyes in the first, second, third, and fourth columns of eyes are connected to the first eye tape.

6. The brassiere of claim 1, wherein the second lateral spacing is greater than the first lateral spacing.

7. The brassiere of claim 6, wherein the second lateral spacing is greater than 1.5 times the first lateral spacing.

8. The brassiere of claim 1, further comprising:

outer layers of fabric together defining the outermost face of the second closure portion; and an inner layer of fabric defining the innermost face of the second closure portion;

wherein the eyes in the first, second, third, and fourth columns of eyes each have anchor ends and hook-receiving ends opposite the anchor ends;

wherein the anchor ends of the eyes are covered by a respective one of the outer layers of fabric; and wherein the hook-receiving ends of the eyes lie on an outer surface of another respective one of the outer layers of fabric.

9. The brassiere of claim 1, wherein the second closure portion is a unitary component comprising each of the first, second, third, and fourth columns of eyes on the second closure portion.

10. A brassiere comprising:

a front;

a first wing extending from a first lateral side of the front and terminating at a first closure portion;

a second wing extending from an opposite, second lateral side of the front and terminating at a second closure portion;

a plurality of hooks on an inner face of the first closure portion that is configured to face toward a wearer's skin while the brassiere is being worn; and a plurality of eyes on an outermost face of the second closure portion that is configured to face away from the wearer's skin while the brassiere is being worn, the plurality of eyes being configured to engage with the plurality of hooks to couple the first and second closure portions together;

wherein eyes in the plurality of eyes are arranged in:

a first column of eyes next to a second column of eyes, the first and second columns of eyes being spaced apart by a first lateral spacing;

a third column of eyes next to the second column of eyes, the second and third columns of eyes being spaced apart by a second lateral spacing that is different from the first lateral spacing; and a fourth column of eyes next to the third column of eyes, the third and fourth columns of eyes being spaced apart by the first lateral spacing;

wherein the second closure portion is a unitary component comprising each of the first, second, third, and fourth columns of eyes on the second closure portion;

wherein the second closure portion includes opposing upper and lower edges, and wherein the second closure portion includes a gap portion entirely defined by the outermost face of the second closure portion between the upper and lower edges and between the second column of eyes and the third column of eyes.

11. The brassiere of claim 10, wherein the first, second, third, and fourth columns of eyes are attached to a single eye tape that forms part of the second closure portion.

12. The brassiere of claim 10, wherein the first and second columns of eyes are attached to a first eye tape and the third and fourth columns of eyes are attached to a second eye tape; and wherein the first and second eye tapes are situated end-to-end and form part of the second closure portion.

13. The brassiere of claim 10, wherein the second closure portion comprises an innermost face configured to face toward the wearer's skin while the brassiere is being worn, the innermost face of the second closure portion being defined by a continuous, unitary layer configured to lie between each of the first, second, third, and fourth columns of eyes and the wearer's skin.

14. The brassiere of claim 13, wherein the innermost face of the second closure portion is defined by a single inner layer of fabric.

15. The brassiere of claim 10, wherein the second lateral spacing is greater than the first lateral spacing.

16. The brassiere of claim 15, wherein the second lateral spacing is greater than 1.5 times the first lateral spacing.

17. A brassiere comprising:

a front;

a first wing extending from a first lateral side of the front and terminating at a first closure portion;

a second wing extending from an opposite, second lateral side of the front and terminating at a second closure portion;

a plurality of hooks on an inner face of the first closure portion that is configured to face toward a wearer's skin while the brassiere is being worn; and a plurality of eyes on an outer face of the second closure portion that is configured to face away from the wearer's skin while the brassiere is being worn, the plurality of eyes being configured to engage with the plurality of hooks to couple the first and second closure portions together;

wherein eyes in the plurality of eyes are arranged in:

a first column of eyes next to a second column of eyes, the first and second columns of eyes being spaced apart by a first lateral spacing;

a third column of eyes next to the second column of eyes, the second and third columns of eyes being spaced apart by a second lateral spacing that is different from the first lateral spacing; and a fourth column of eyes next to the third column of eyes, the third and fourth columns of eyes being spaced apart by the first lateral spacing;

wherein the first and second columns of eyes are attached to a first eye tape and the third and fourth columns of eyes are attached to a second eye tape;

wherein the first and second eye tapes are situated end-to-end and form part of the second closure portion; and wherein the second closure portion is a unitary component comprising each of the first and second eye tapes and each of the first, second, third, and fourth columns of eyes.

18. The brassiere of claim 17, further comprising:

an outer layer of fabric defining the outer face of the second closure portion; and an inner layer of fabric defining an inner face of the second closure portion that is configured to face toward the wearer's skin while the brassiere is being worn;

wherein the first and second eye tapes are sandwiched between the inner and outer layers of fabric.

* * * * *